US007186130B1

(12) United States Patent
Miller

(10) Patent No.: US 7,186,130 B1
(45) Date of Patent: Mar. 6, 2007

(54) PLUG RETENTION APPARATUS

(75) Inventor: Thomas J. Miller, Diamond Bar, CA (US)

(73) Assignee: TMC Enterprises, Diamond Bar, CA (US)

( * ) Notice: Subject to any disclaimer, the term of this patent is extended or adjusted under 35 U.S.C. 154(b) by 0 days.

(21) Appl. No.: 11/188,206

(22) Filed: Jul. 21, 2005

Related U.S. Application Data

(63) Continuation-in-part of application No. 10/777,401, filed on Feb. 12, 2004, now Pat. No. 6,957,977.

(60) Provisional application No. 60/661,053, filed on Mar. 10, 2005, provisional application No. 60/519,762, filed on Nov. 13, 2003.

(51) Int. Cl.
*H01R 13/62* (2006.01)

(52) U.S. Cl. ..... 439/369

(58) Field of Classification Search ..... 439/369, 439/371, 373

See application file for complete search history.

(56) References Cited

U.S. PATENT DOCUMENTS 1,665,095 A 4/1928 Henry
2,753,536 A 7/1956 Tjader
3,344,393 A 9/1967 Hendee
3,609,638 A 9/1971 Darrey
4,204,738 A 5/1980 Tilotson
4,875,874 A 10/1989 Windsor, Jr.
5,211,573 A 5/1993 Cross
5,393,243 A 2/1995 Carmo
5,584,720 A 12/1996 Elswick
5,785,547 A 7/1998 Cross et al.
5,834,690 A 11/1998 Bastiaansen
5,913,692 A * 6/1999 Targett ..... 439/369
6,056,580 A 5/2000 Cross et al.
6,080,004 A 6/2000 Kovacik et al.

* cited by examiner

*Primary Examiner*—Neil Abrams
(74) *Attorney, Agent, or Firm*—Knobbe Martens Olson & Bear LLP

(57) ABSTRACT

A plug retention apparatus for use in securing two plug members together to prevent undesired disengagement. The plug retention apparatus is affixed to a first plug member using a retention ring which provides a means for adjustable positioning via a threaded coupling to facilitate securing a second plug member to the first plug member. A plug clamp may be rotatably positioned about the second plug member retaining the plug members in a desired position. The clamp used for retaining the second plug may include a cord support, a latch to secure the cord on the support and a locking mechanism to selectively retain the latch in a closed position.

25 Claims, 15 Drawing Sheets

PLUG RETENTION APPARATUS

RELATED APPLICATIONS

This application is a continuation-in-part of U.S. patent application Ser. No. 10/777,401 filed Feb. 12, 2004, now U.S. Pat. No. 6,957,977, which claims the benefit of U.S. Provisional Application 60/519,762, filed Nov. 13, 2003, which is hereby incorporated by reference in its entirety herein and should be considered a part of this specification. This application also claims priority to U.S. Provisional Application No. 60/661,053, filed Mar. 10, 2005, which is hereby incorporated by reference in its entirety and should be considered a part of this specification.

BACKGROUND

1. Field of the Invention

The present teachings relate to electrical cords and, in particular, to a device and methods for maintaining engagement between electrical plug connections.

2. Description of the Related Art

Electrical devices such as power tools, household appliances, and other consumer electronics often possess a cord having a plug to be engaged with a receiving socket such as that found on an extension cord or the like. The cords of these devices are subject to snagging and may be easily disengaged, interrupting the electrical connection and posing a potential safety hazard if the plug becomes partially disengaged thereby exposing the contacts.

To address this issue, it has been suggested to position a retaining structure over the connected plugs or sockets to prevent disengagement of the plugs. Unfortunately, typical retaining structures are not adaptable to fit different sizes of electrical plugs. For example, U.S. Pat. No. 4,204,738 to Tillotson illustrates a typical electrical cord securing device that has a securing member attached to the male end of an electrical cord. The securing member is adapted to attach to the mating electrical cord. However, the securing member is not adjustable. Hence, the cord that is to be attached and secured with this device must be sized to the securing device which limits the use of the securing device to just a single cord.

A further difficulty with plug securing devices is that the portion that actually attaches to the electrical cord can become dislodged as a result of force exerted on the cord. It will be appreciated that in many different circumstances, the forces exerted on the cords can be quite large as people are pulling or otherwise flexing the cords. Hence, there is a continuing need to be able ensure that the plug retention apparatus is less likely to become dislodged from the cord or plug.

Yet another difficulty with existing electrical plug retaining devices is that the retaining devices are generally set up for cords having a single plug. In many industrial and construction applications, multiple electrical devices are attached to electrical cords having multiple plug assemblies. Construction applications in particular are very susceptible to cords being dislodged due to the rough use of tools that often occurs in construction environments.

Based on the foregoing, there is an ongoing need for improved securing devices that ensure that electrical cords remain plugged together. To this end, there is a need for securing devices that are less likely to be dislodged from the plugs or cords and are also better able to accommodate multiple plugs and cords.

SUMMARY

In various embodiments, the present teachings describe a plug retention device used in conjunction with a socketed electrical cord wherein the electrical cord comprises a first plug member that is retained in contact with a second plug member by way of a securing clamp. At least one plug member is threaded to accommodate a retention ring that may be adjustably positioned about the threaded plug member. A plug clamp is attached to the retention ring in such a manner so as to allow pivotal positioning. The plug clamp further comprises a cord guide which secures the cord and allows it to be passed through a portion of the plug clamp in an unobstructed manner. In various embodiments, the first plug member comprises a male plug member having at least one conductive element extending therefrom and the second plug member comprises a female plug member having a receiving socket into which the at least one conductive element is desirably secured to establish an electrical connection between the two plug members. The plug retention device secures the connection between plug members via the plug clamp which is positioned about one of the plug members and retained in a first position preventing axial movement of the plug members by the retention ring secured to the opposing plug member.

In one embodiment, the aforementioned needs may be satisfied by an electrical cord assembly comprising a cord suitable for supplying electrical power to an appliance and a first plug member attached to the cord, wherein the first plug member includes a threaded surface, and wherein the first plug member is adapted to couple to a second plug member having an associated cord so as to provide electrical power thereto. The electrical cord assembly may further comprise a retainer assembly threadably engaged with the first plug member so as to be movable in a direction either towards or away from the first plug member wherein the retainer assembly includes an engagement member that engages with the cord attached to the second plug member and wherein the retainer assembly can be threadably moved on the first plug member such that the engagement member can be tightened against the second plug member to thereby retain the first and second plug members in contact with each other.

In one aspect, the first plug member comprises a male electrical cord plug. The first plug member includes a body having a first and a second end and an outer surface extending from the first and the second end, wherein the first end is adapted to be engaged with the second plug member and the second end is connected to the cord and wherein the outer surface of the plug body comprises the threaded surface. The retainer assembly comprises a collar that is threaded so as to be threadably engaged with the threaded surface of the first plug member wherein the engagement member is pivotally mounted to the collar so as to be movable between a first position and a second position.

In another aspect, the engagement member comprises two members that each attach to the collar and a cross piece interconnecting the two members wherein the cross piece includes an engagement surface that engages with the cord on the second plug assembly. The engagement surface comprises a depression in the cross piece that is contoured so as to fit around the cord of the second plug assembly. The engagement member further comprises a securing member pivotally attached to the cross piece so as to be movable between an open position and a closed position wherein the securing member in the open position allows the second cord to be positioned in the depression and wherein the securing member in the closed position allows the second cord to be secured in the depression. The engagement members are pivotally attached to the collar member such that the engagement member can be secured to the first cord when the retainer assembly is not in use securing the first and second plugs together.

The aforementioned needs may also be satisfied by a cord assembly comprising, in one embodiment, a first cord member suitable for conducting electricity and a first plug member electrically coupled to the first cord member, wherein the first plug member includes a threaded shaft portion interposed between a head portion and a base portion, wherein the first plug member is adapted to receive a second plug member adjacent the head portion. In addition, the cord assembly may further comprise a ring member having threads that engage the threaded shaft portion of the first plug member, wherein the ring member is movable along the shaft portion between the head and base portions of the plug member. Moreover, the cord assembly may further comprise a clamp member attached to the ring member so as to pivot about the point of attachment, wherein the clamp member couples with a second cord member that is electrically coupled to the second plug member, and wherein the clamp member secures the second plug member adjacent the first plug member when the ring member is threaded towards the base portion of the first plug member, and wherein the clamp member is loosened when the ring member is threaded towards the head portion of the first plug member.

The aforementioned needs may also be satisfied by a method of interconnecting two electrical cords with matching plugs. In one embodiment, the method comprises inserting a first plug assembly of the first electrical cord to a second plug assembly of the second electrical cord and threadably engaging a retaining structure onto the first cord assembly. In addition, the method further comprises coupling the retaining structure to the second electrical cord and threadably moving the retaining structure with respect to the first plug assembly such that a portion of the retaining structure engages the second plug assembly and urges the second plug assembly towards the first plug assembly to thereby inhibit disengagement between the first and second plug assemblies.

These and other aspects, advantages, and novel features of the present teachings will become apparent upon reading the following detailed description and upon reference to the accompanying drawings.

DETAILED DESCRIPTION OF CERTAIN EMBODIMENTS

In the following detailed description, terms of orientation such as "front," "rear," "top" and "bottom" are used to simplify the description of the context of the illustrated embodiments. Likewise, terms of sequence, such as "first," and "second" are used to simplify the description of the illustrated embodiments. Because other orientations and sequences are possible, however, the present invention should not be limited to the illustrated orientations. Those skilled in the art will appreciate that other orientations of the various embodiments disclosed herein are possible.

Reference will now be made to the drawings wherein like numerals refer to like parts throughout. An apparatus for maintaining engagement between electrical plug connections will be described in greater detail herein below with reference to the drawings.

Figure 1:
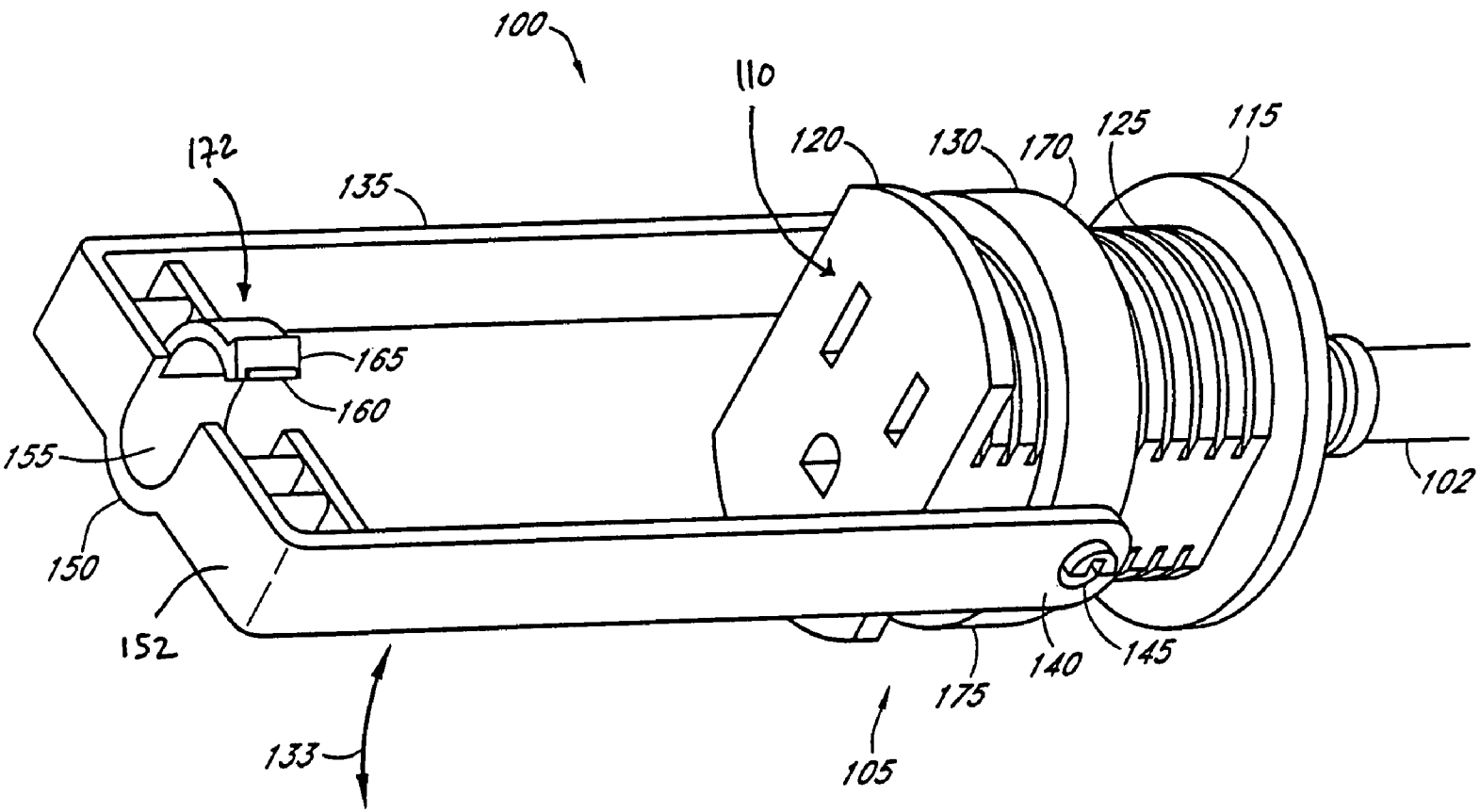
FIGS. 1–3 illustrate one embodiment of the plug retention apparatus.

FIG. 1 illustrates one embodiment of a plug retention apparatus 100. The plug retention apparatus 100 comprises a first plug member 105 attached to one end of an electrical cord 102 having a receiving socket 110 adapted to receive conductive elements of a second plug member 200 (FIGS. 4–7). In general, the electrical cord 102 may comprise any cord member suitable for supplying electrical power to a household or commercial device, such as an appliance. In various embodiments, the first plug member 105 comprises a female plug that is adapted to accommodate connection to conventional electrical cords such as those found on household electronics, power tools, and the like. It should be appreciated, however, that the first plug member 105 may also comprise a male plug that is adapted to accommodate connection to conventional electrical cords.

The first plug member 105 further comprises a base portion 115 and a head portion 120 having a threaded section 125 disposed between the base portion 115 and the head portion 120. In one aspect, the threaded section 125 comprises a threaded shaft interposed between the base and head portions 115, 120 of the first plug member 105. Also, the threaded section or shaft 125 is an integral part of the plug member 105. In addition, a retention ring or collar 130 is secured to the first plug member 105 about the threaded section 125, wherein the retention ring 130 is adapted to moveably engage the first plug member 105 about the threaded section 125. In one aspect, the retention ring 130 comprises a threaded interior surface that is adapted to engage the threaded section 125 of the first plug member 105. Advantageously, this allows the retention ring 130 to move along the threaded section 125 between the base and head portions 115, 120 of the first plug member 105.

Additionally, in various embodiments, the retention ring 130 may be positioned about the first plug member 105 by rotational motion in which the retention ring 130 is adapted to engage the threaded section 125 to move up or down as desired. In one aspect, axial movement of the retention ring 130 about the first plug member 105 is constrained between the base portion 115 and the head portion 120 such that the retention ring 130 is constrained to a range of positions. As will be described in greater detail herein below, movement and positioning of the retention ring 130 in the aforementioned manner desirably provides a means by which to adjust the retention ring 130 to accommodate joining of the second plug member 200 with the first plug member 105 to be thereafter secured in position preventing undesirable disengagement.

Figure 4:
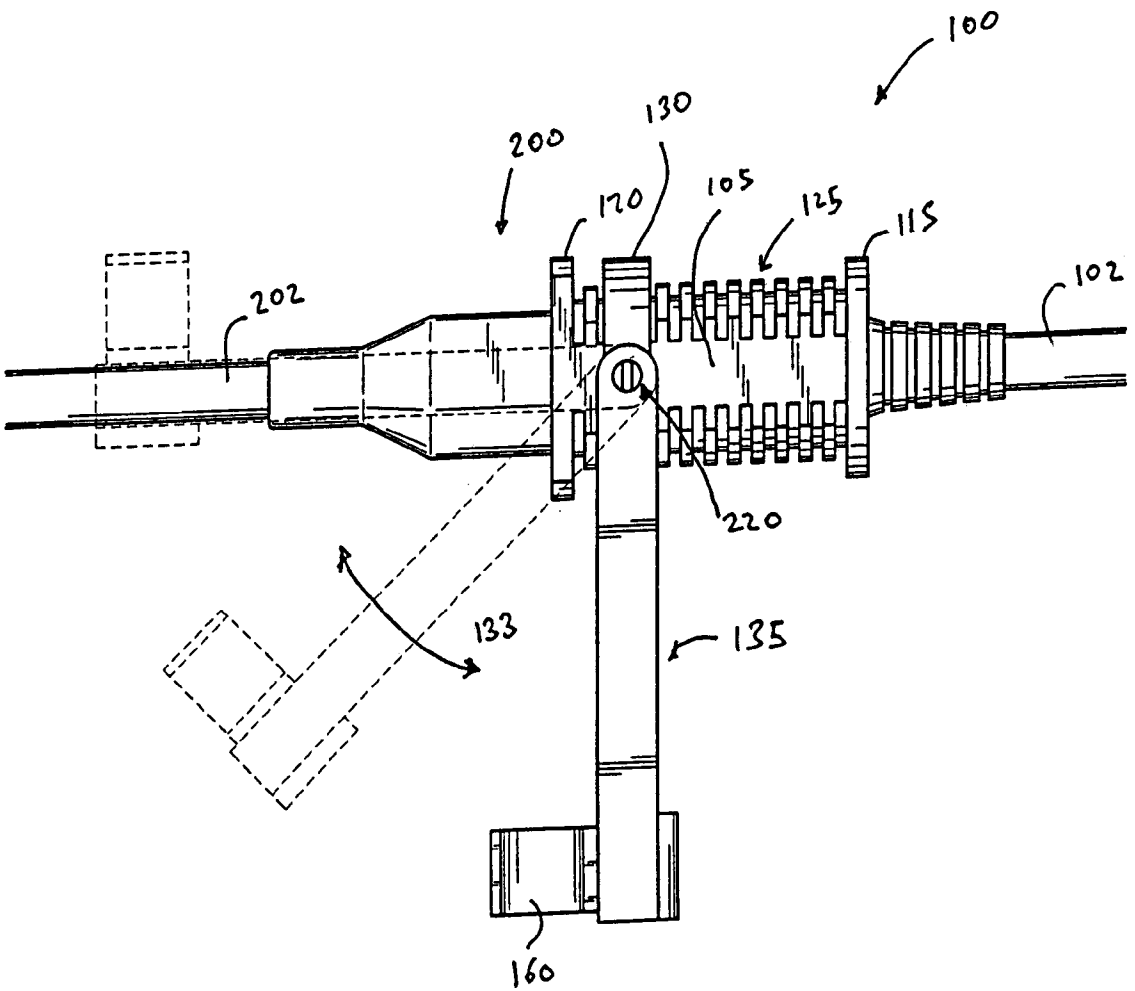
FIG. 4 illustrates the pivotal movement of a member of the plug retention apparatus.

A plug clamp 135 is further secured to the retention ring 130, wherein the plug clamp 135 comprises a U-shaped member having first and second pivot ends 140. Each pivot end 140 may comprise a through-going opening adapted to receive a grommet portion 145 of the retention ring 130 that secures the plug clamp 135 to the retention ring 130. When attached in this manner, the plug clamp 135 may be angularly pivoted 133 from the first plug member 105 to facilitate joining with the second plug member 200 as illustrated in FIG. 4.

Additionally, the plug clamp 135 further comprises a cord guide 150 positioned along a cross member portion 152 of the plug clamp 135. The cord guide 150 comprises an opening 155 in the plug clamp 135 which is adapted to receive a portion of an electrical cord attached to the second plug member 200. In one aspect, the cord guide 150 allows passage of the electrical cord attached to the second plug member 200 through a portion of the plug clamp 135 in a substantially unobstructed manner while at the same time retaining the electrical cord 102 in a desired position.

Figure 5:
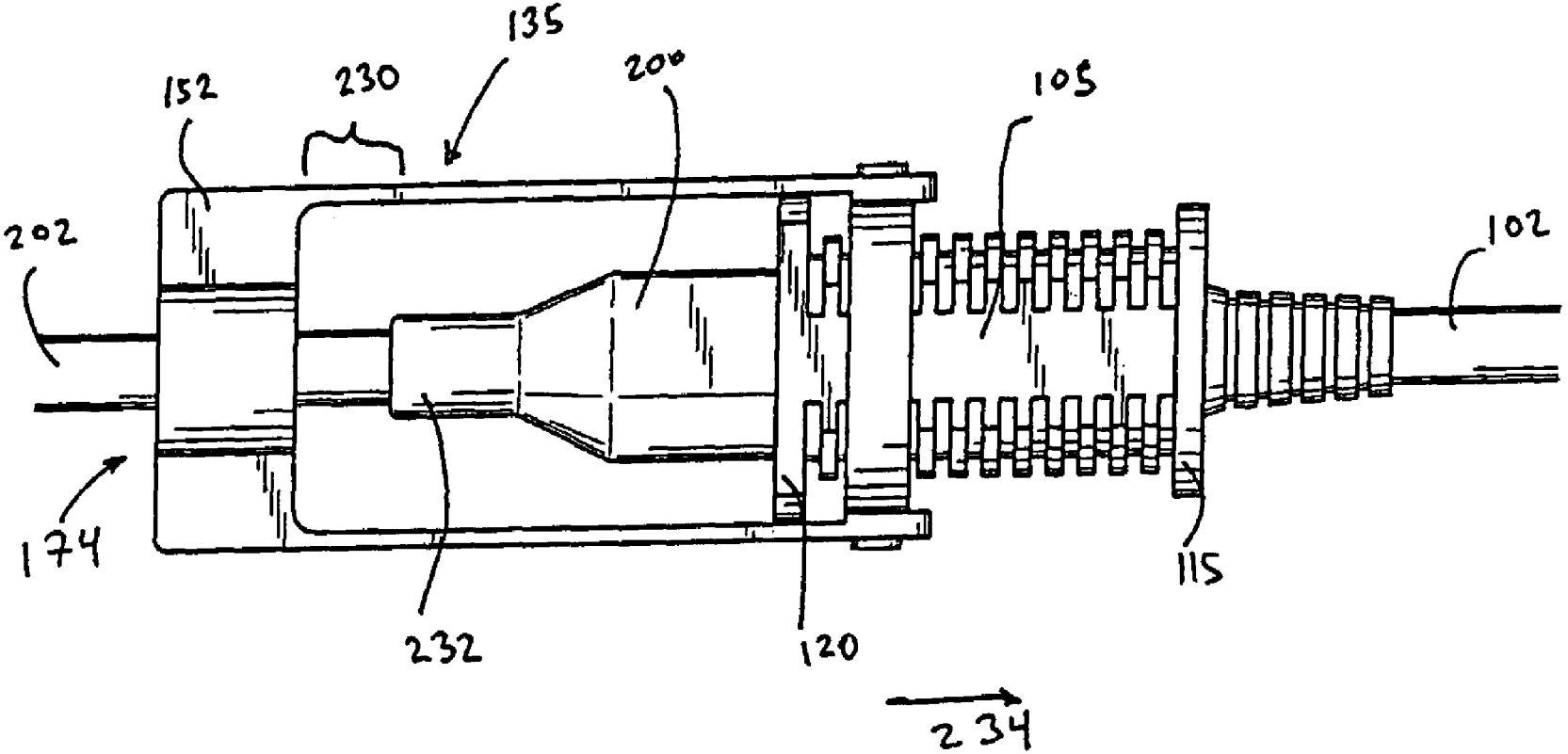
FIGS. 5–6 illustrate one embodiment of securing a plurality of cord members with the plug retention apparatus.
Figure 6:
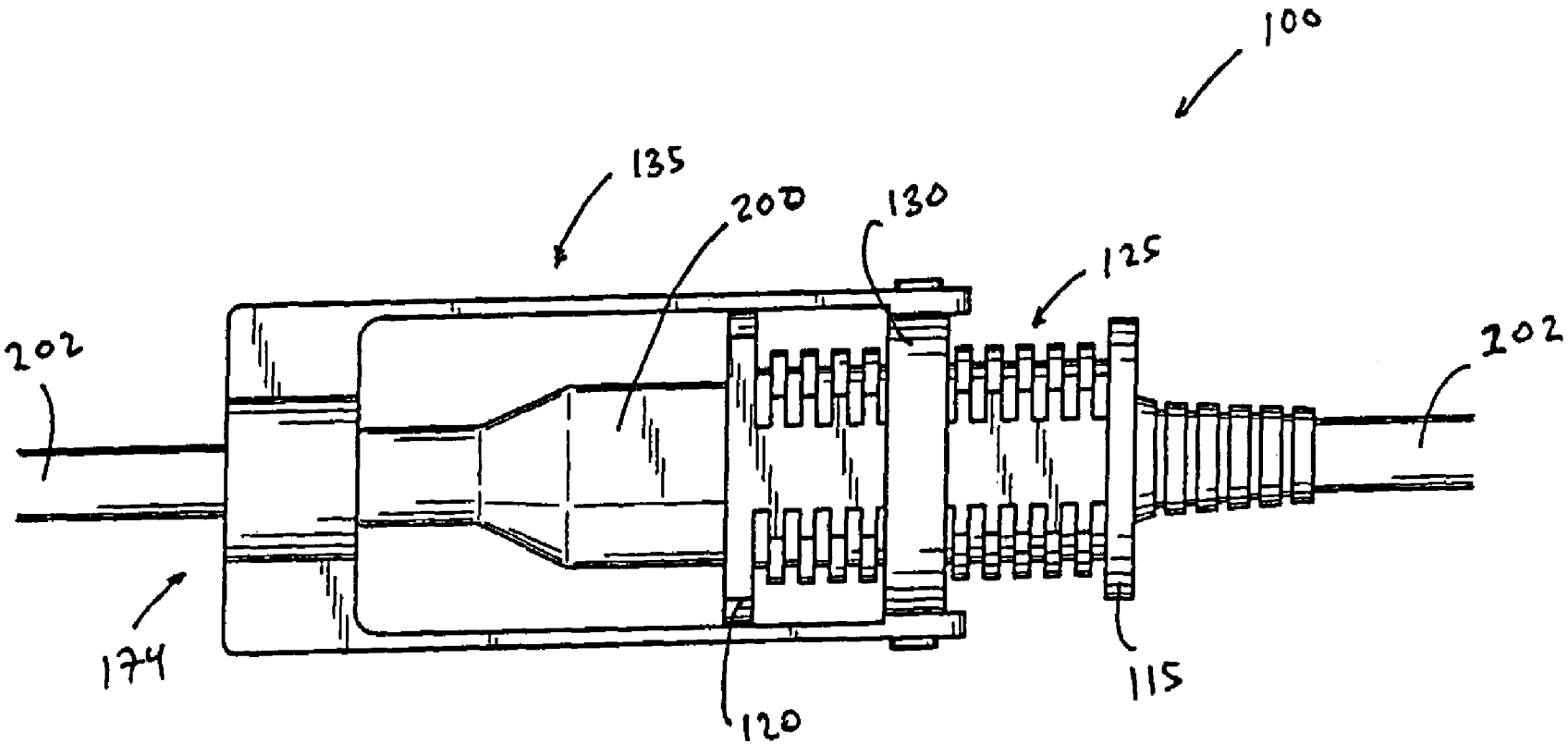

Moreover, in one aspect, the cord guide 150 comprises a latching member 160 that may reside in a first open position 172 as illustrated in FIG. 1, wherein an opening is formed to allow the electrical cord 102 attached to the second plug member 200 to be captured within the opening 155 of the cord guide 150. The latching member 160 may be further retained in a second closed position 174, as illustrated in FIGS. 5–6, so as to be secured to a portion of the cord guide 150 by way of a latch 165. When so positioned as described for example, the latching member 160 may be adapted to capture a portion of the electrical cord 102 passed through the cord guide 150 allowing the electrical cord 102 to be angularly positioned above the first plug member 105 as the plug clamp 135 is moved into position about the second plug member 200 (FIG. 4). Preferably, the latching member 160 is movable into the first open position 172 and the second closed position 174 via a hinge 254 which attaches the latching member 160 to the cross member portion 152 of the plug clamp 135.

In various embodiments, the ring member 130 may comprise detachable sections 170, 175 which allow for placement and removal from the threaded section 125. The detachable sections 170, 175 may further be secured via the grommets 145 which join the detachable sections 170 upon fastening of the plug clamp 135. Taken together the construction of the plug retention apparatus 100 is such that it may be designed as a part integrated into the first plug member 105 or alternatively may be adapted as a removable component. In one aspect, as illustrated in FIG. 4, the plug clamp 135 pivots about the grommets 145 so as to capture a portion of the electrical cord 102 within the opening 155 of the cord guide 150.

Figure 2:
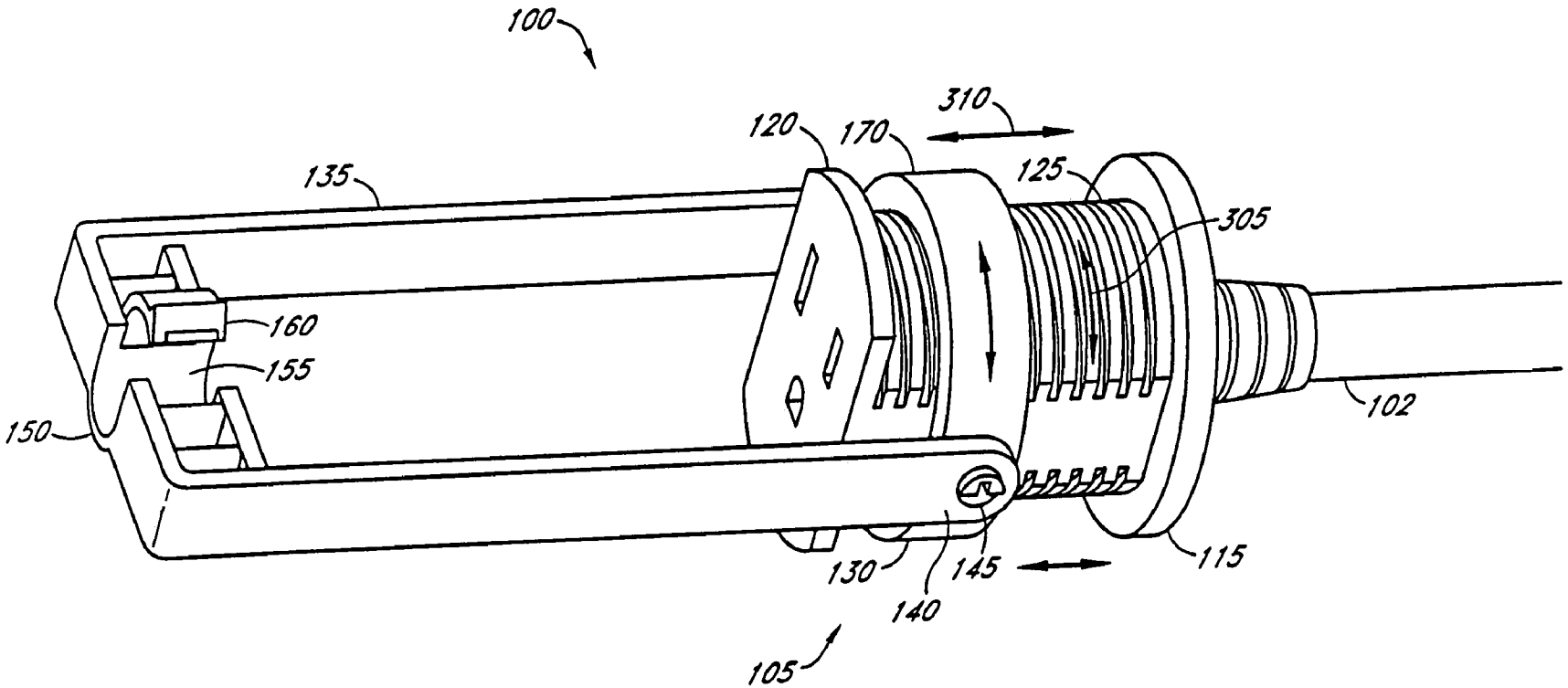
Figure 3:
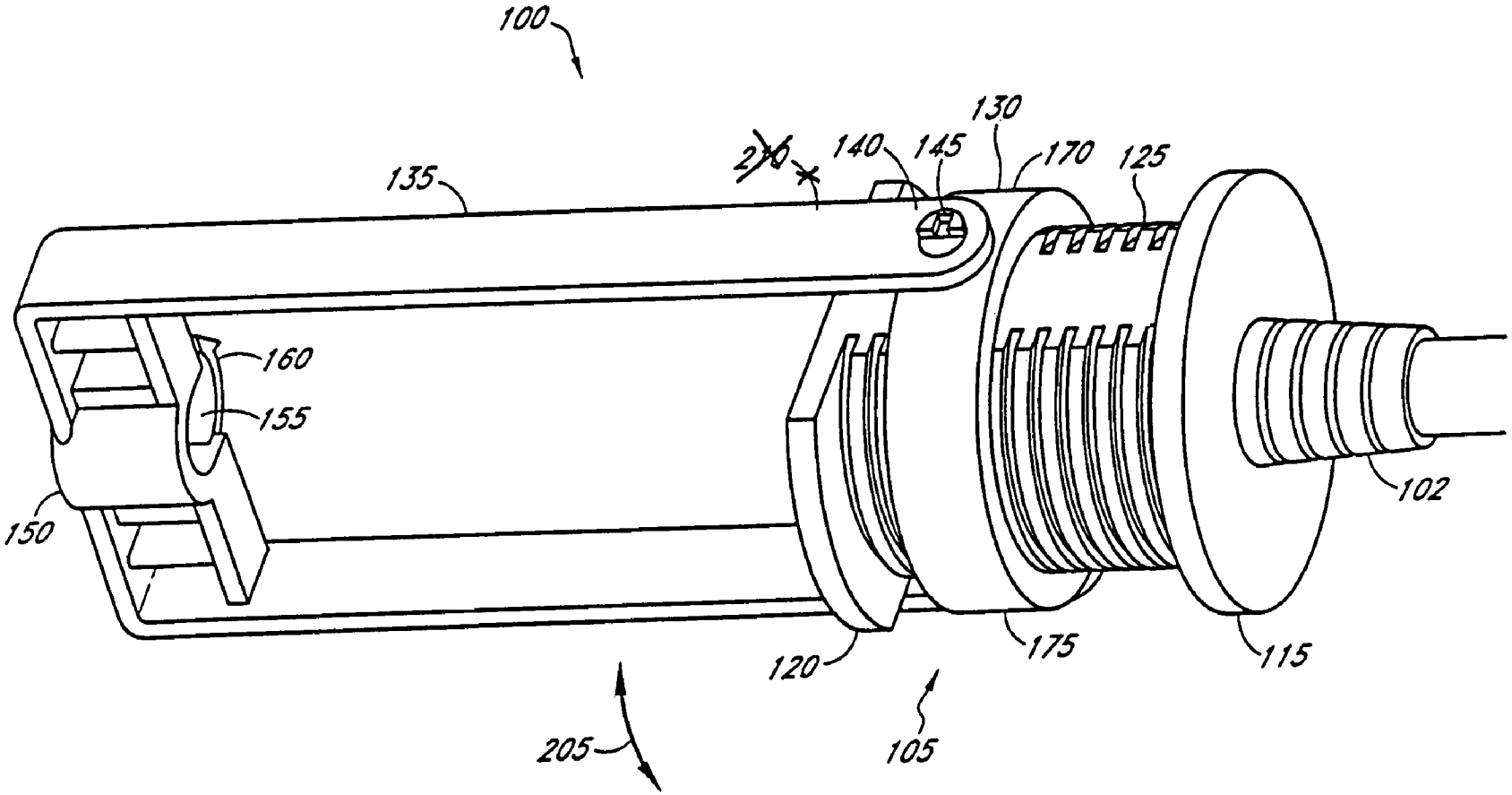

FIG. 2 illustrates a rear perspective view of the plug retention apparatus 100. FIG. 3 illustrates a side perspective view of the plug retention apparatus 100 wherein positioning of the retention ring is used to secure the first and second plug members 105, 200. In one aspect, as illustrated in FIGS. 2–3, the general construction of the plug clamp 135 and cord guide 150 from this perspective further illustrates how the electrical cord 102 may be retained within the opening 155 of the cord guide 150. In addition, the pivot arrows 205, 210 indicate how the plug clamp 135 may be positioned to accommodate joining of the second plug member 200 with the first plug member 105. Once the plug members 105, 200 have been engaged in a manner as illustrated in FIGS. 4–7, the plug clamp 135 may be repositioned over the second plug member 200, wherein the cord guide 150 captures the electrical cord 202 associated with the second plug member 200.

Figure 7:
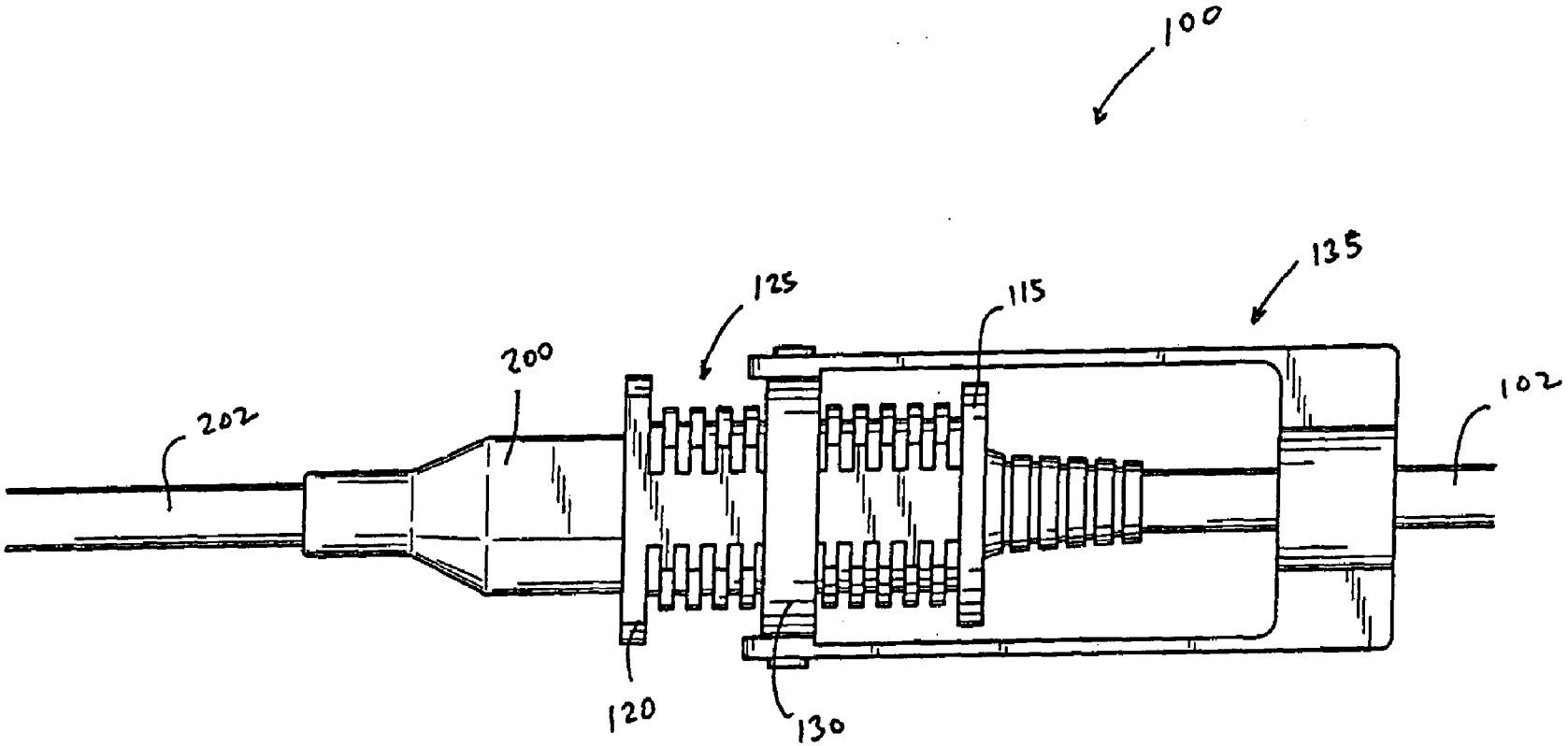
FIG. 7 illustrates another embodiment of securing the plug retention apparatus to a cord member.

As further illustrated in FIGS. 2–3, the retention ring 130 may be rotatably positioned about the threaded member 125 as illustrated by arrow 305. In one aspect, as illustrated in FIGS. 5–6, rotation of the retention ring 130 engages the threads of the threaded member 125 in such a manner so as to result in axial movement 310 along the shaft of the threaded member 125 of the plug retention apparatus 100. Advantageously, this allows ring member 130, including the plug clamp 135, to move axially between the base portion 115 and the head portion 120 of the first plug member 105 so as to secure the second plug member 200 to the first plug member 105. In this position, the second plug member 200 is positioned adjacent the head portion 120 of the first plug member 105. In addition, the retention ring 130 is desirably positioned about the threaded member 125 in such a manner so that when the first plug member 105 is engaged with the second plug member 200 and the plug clamp 135 is positioned about the second plug member 200 the connection between the two plug members 105, 200 is secured. Moreover, as illustrated in FIG. 7, the clamp member 135 can be pivotally attached to the ring member 130 such that the clamp member 135 can be secured to the first cord member 102 when the plug retention apparatus 100 is not in use securing the first and second plug members 105, 200 together.

In one aspect, the secured position between the two plug members 105, 200 may be accomplished by rotating the plug clamp 135 into a position wherein its axial position is generally in-line with the first plug member 105. When so positioned the plug clamp 135 is retained in an axially fixed position by the retention ring 130. Thus, when so positioned the first and second plug members 105, 200 are desirably secured and resistant to separation. Moreover, the opening 155 in the cord guide 150 can be used to capture the electrical cord 202 extending from the second plug member 200 and the latching member 160 closed to thereby secure the electrical cord 202 extending therefrom.

FIG. 4 further illustrates a method of securing cord members including the first and second cords 102, 202. In one embodiment, the method comprises engaging the first plug member 105 to the second plug member 200. As previously described, the first plug member 105 is electrically coupled to the first cord member 102 and includes the plug clamp 135 that pivots about a pivot point 220 on the retention ring 130. The plug clamp 135 is secured to the retention ring 130 via the first and second pivot ends 140 in a manner such that each pivot end 140 includes through-going apertures that are adapted to receive the protruding grommets 145 of the retention ring 130. As illustrated in FIG. 4, when attached in this manner, the plug clamp 135 may be angularly pivoted 133 from the first plug member 105 to facilitate coupling with the second cord member 202. In addition, the retention ring 130 threadably couples to the threaded shaft portion 125 of the first plug member 105.

FIG. 5 illustrates the coupling of the plug clamp 135 to the second cord member 202. In one embodiment, as illustrated in FIG. 5, when the retention ring 130 is positioned adjacent to the head portion 120 of the first plug member 105, the cross member portion 152 of the plug clamp 135 is positioned a first distance 230 from a rear portion 232 of the second plug member 200. In this position, the retention ring 130 can be threaded along the shaft portion 125 of the first plug member 105 in a first direction 234 towards the base portion 115 of the first plug member 105 so as to close the gap of the first distance 230 therebetween.

FIG. 6 illustrates the positioning of the plug clamp 135 adjacent to the second cord member 202. In one embodiment, as illustrated in FIG. 6, when the retention ring 130 is threaded towards the base portion 115 of the first plug member 105, the cross member portion 152 of the plug clamp 135 is positioned adjacent to the rear portion 232 of the second plug member 200. In this position, the retention ring 130 is threadably tightened or cinched along the shaft portion 125 of the first plug member 105 in the first secure position and the second plug member 200 to the first plug member 105. This position further closes the gap of the first distance 230 therebetween so that the second plug member 202 cannot be removed from the first plug member 105. Advantageously, the threaded connection between the retention ring 130 of the plug clamp 135 and the shaft portion 125 of the first plug member 105 allows the second plug member 202 to be secured to the first plug member 105 without interfering with the electrical conduction therebetween. Additionally, this method of securing a plurality of cord members together improves operational safety by reducing the risk of disengaging the plug members 105, 200 during use.

FIG. 7 illustrates the ability of the plug clamp 135 of the first plug member 105 to be secured to the first cord member 102 during times of non-use or non-operation. In addition, this position also allows the second plug member 200 to be removed or disengaged from the first plug member 105. It should be appreciated that the method as disclosed in FIGS. 4–6 can be reversed in order so as to pivot the plug clamp away from the second cord member 202 and towards the first plug member 105 so as to couple the plug clamp 135 to the first plug member 102. Advantageously, this position prevents the clamp member 135 from flailing about during non-use, transport, or for storage.

Figure 8:
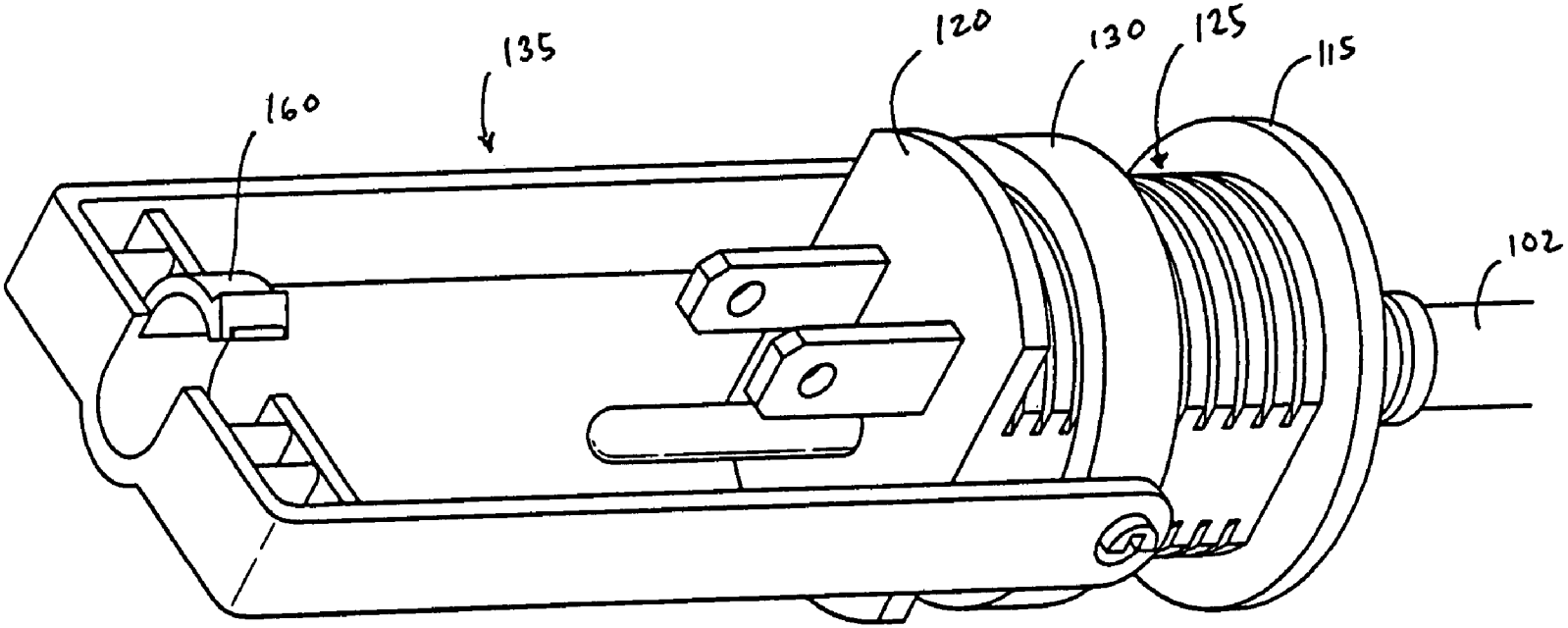
FIG. 8 illustrates another embodiment of the plug retention apparatus.

It should be appreciated by those skilled in the art that the plug retention apparatus 100 may be adapted to a male plug member 250 in manner as illustrated in FIG. 8. Also, the retention ring 130 may be adapted to be secured to and moved about the male plug member 250 in a similar manner as previously described with reference to the first plug member 105, which may comprise, for example, a female plug member. Therefore, the present teachings of the plug retention apparatus 100 as described herein should include various embodiments that are adaptable to male and female plug members.

Figure 9:
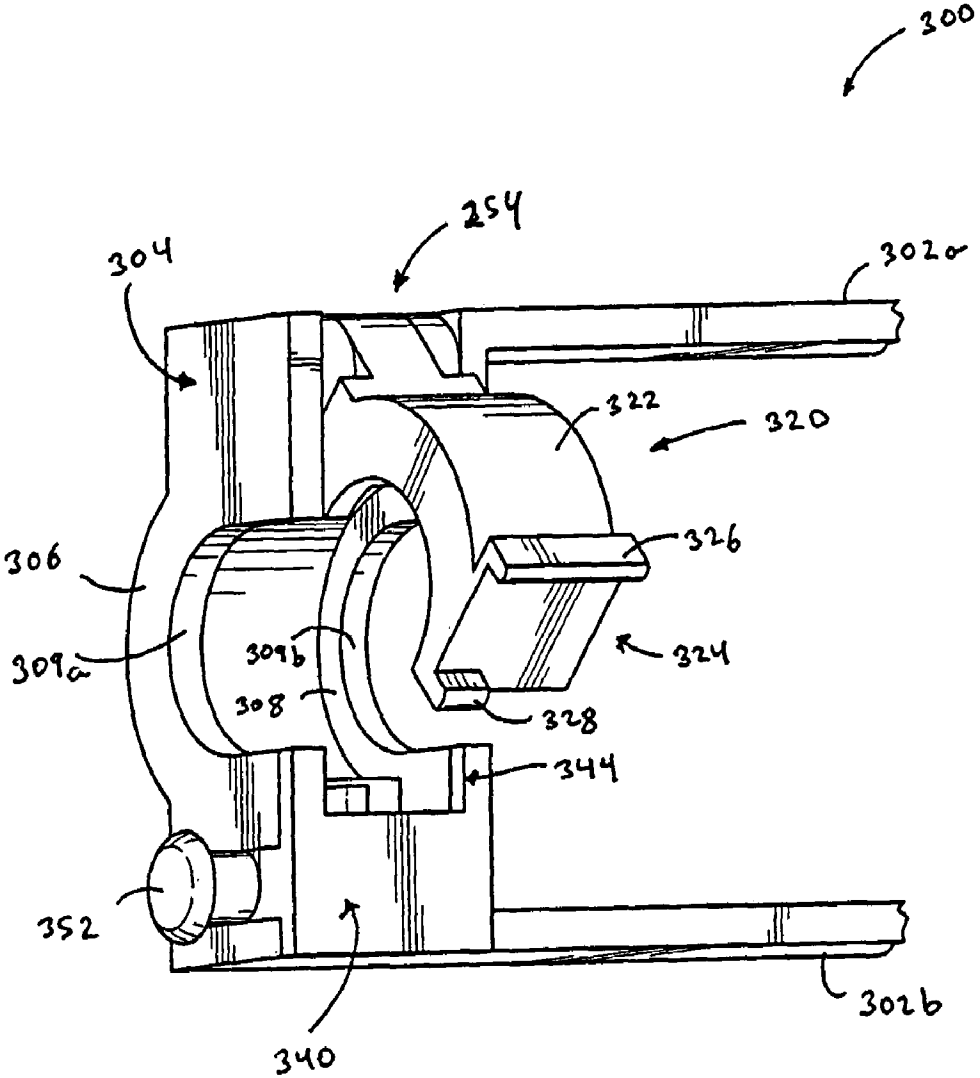
FIGS. 9–12 illustrate yet another embodiment of the plug retention apparatus.

FIG. 9 illustrates yet another embodiment of a plug clamp 300 for the plug retention apparatus 100. In the illustrated embodiment, the plug clamp 300 includes a first elongated member 302*a*, a second elongated member 302*b* generally parallel to the first elongated member 302*a*, and a cross member 304 disposed between the elongated members 302*a*, 302*b*. The cross member 304 includes a front member 306 and a rear member 308, having cord guide surfaces 309*a*, 309*b*, respectively, for supporting an electrical cord thereon.

Figure 10:
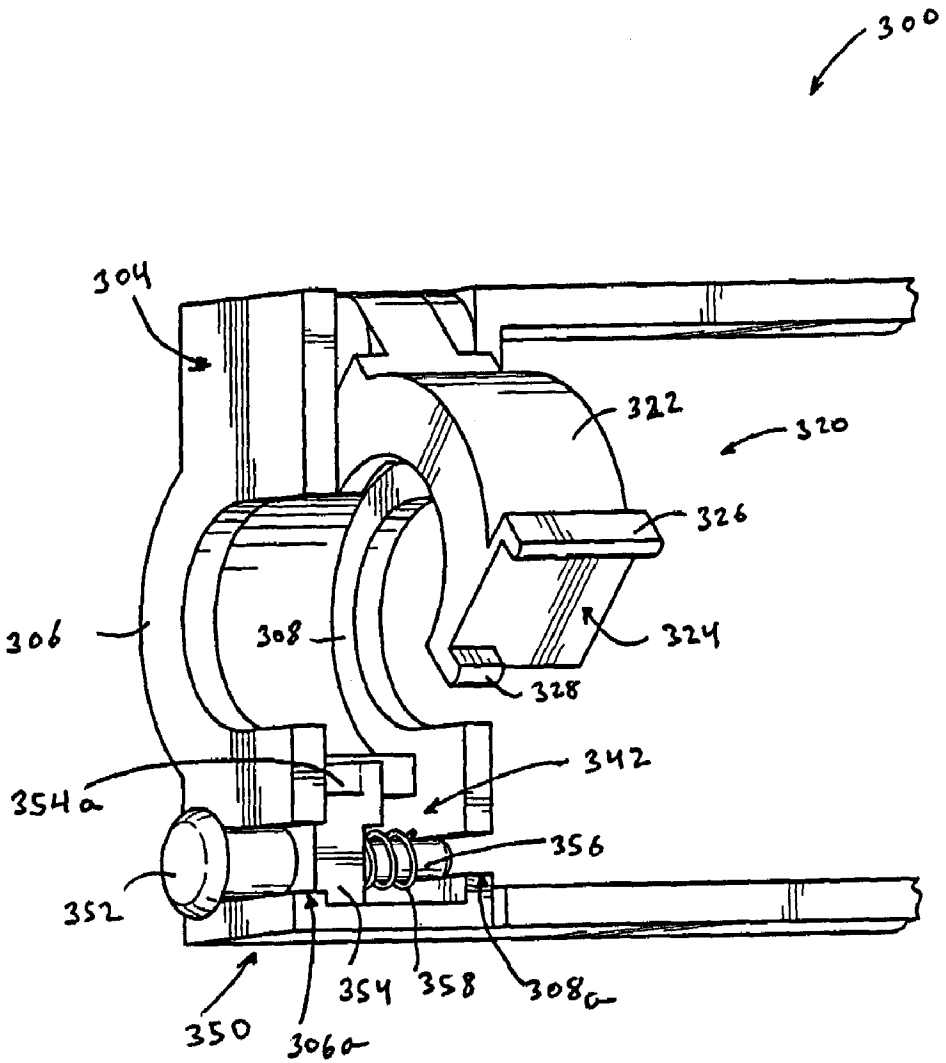

A securing member or latch 320 is movably connected to the cross member 304 and includes an arm 322 and a latching member 324. Preferably, the latch 320 is moveable between an open position (see FIG. 9) and a closed position (see FIG. 11). Additionally, the latch 320 has an inner surface 320*a*, which together with the cord guide surfaces 309*a*, 309*b* defines a cord passage 330 when the latch 320 is in the closed position. As shown in FIGS. 9 and 10, the latching member 324 includes a flange 326 and a tab 328. In the illustrated embodiment, the latch 320 is connected to the cross member 304 via the hinge 254 However, one of ordinary skill in the art will recognize that other mechanisms can be used to operatively connect the latch 320 to the cross member 304.

As shown in FIGS. 9 and 10, the cross member 304 also includes a body 340 with an inner compartment 342 defined between the front and rear members 306, 308. Preferably, the front and rear members 306, 308 are spaced apart by a distance sufficient to receive the latching member 324 therebetween and allow the flange 326 to align with an opening 344 on the body 340. In one preferred embodiment, the flange 326 is generally flush with the opening 344 when the latch 320 is in the closed position.

In the illustrated embodiment, the compartment 342 houses a locking mechanism 350 therein. The locking mechanism 350 includes an actuator button 352, a locking member 354 with an angled surface 354*a*, a post 356, and a spring 358 (See FIGS. 10–12). As shown in FIG. 10, the button 352 slidably extends through an opening 306*a* in the front member 306. Similarly, the post 356 slidably extends through an opening 308*a* in the rear member 308. In the illustrated embodiment, the openings 306*a*, 308*a* are aligned with each other so that the button 352 and post 356 extend along an axis. The locking member 354 is preferably slidably movable along the axis and is biased against the front member 306 by the spring 358, which is disposed between the locking member 354 and the rear member 308 and exerts a force on the locking member 354.

The locking mechanism 350 can preferably be actuated to slidably move the locking member 354 from a first position adjacent the front member 306 to a second position away from the front member 306. In one embodiment, the button 352 and post 356 are attached separately to the locking member 354. In another embodiment, the button 352 and post 356 are integral and are coupled to an opening (not shown) in the locking member 354 via, for example, a press-fit connection. As described further below, the locking mechanism 350 (See FIGS. 10–12) preferably secures the latching member 324, and therefore the latch 320, to the body 340. Additionally, when the latch 320 is in the closed position, the locking mechanism 350 advantageously inhibits the disengagement of the latch 320 and the withdrawal of a cord disposed in the cord passage 330 due to a force exerted on the latch 320. Such a force can occur, for example, when a user rotates the retention ring 130 (FIG. 1) on the threads 125 to tighten the first and second plug members 105, 200 together.

Figure 11:
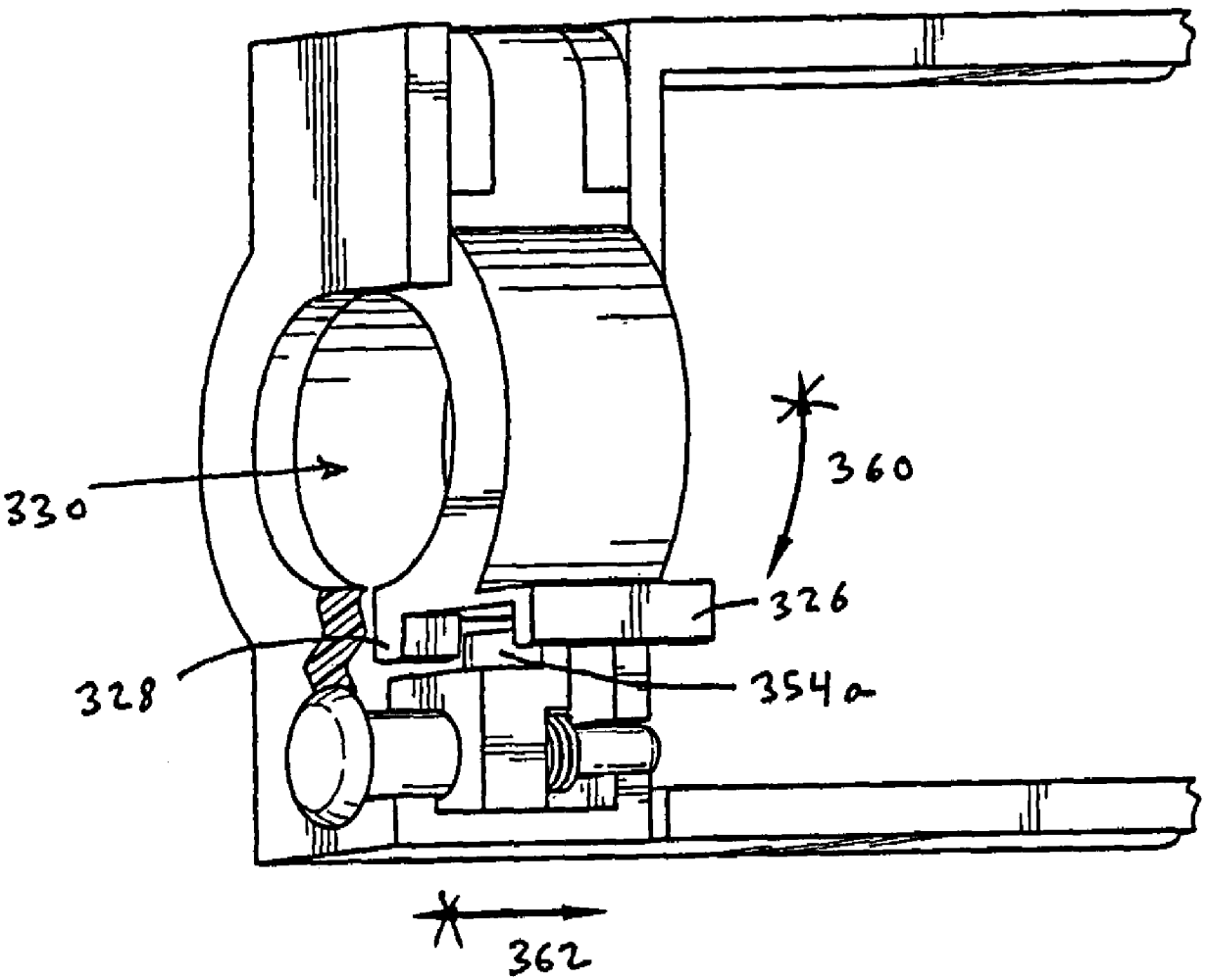
Figure 12:
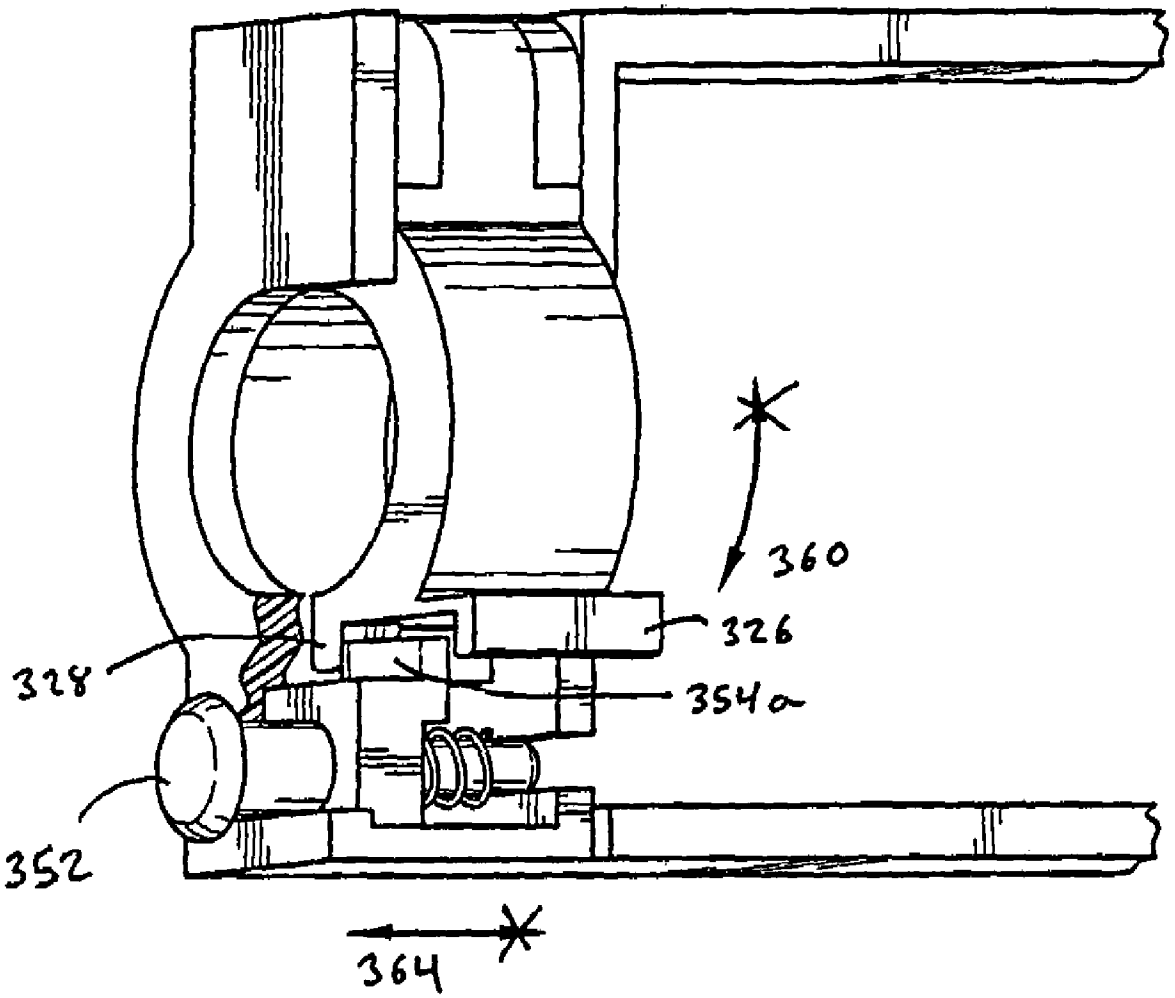

FIGS. 10–12 illustrate the operation of the locking mechanism 350. As shown in FIG. 10, the latch 320 is in the open position and the locking mechanism 350 is in a rest position, with the locking member 354 biased by the spring 358 against the front member 306 of the cross member 304. As the latch 320 is rotated downward 360 into the closed position, the tab 328 slides over the angled surface 354*a* and exerts a downward force thereon. Said downward force preferably overcomes the biasing force from the spring 358 and moves the locking member 354 in a forward direction 362 (See FIG. 11). Once the tab 328 clears the bottom of the angled surface 354*a*, the biasing force from the spring 358 moves the locking member 354 in the opposite direction 364 and back against the front member 306, placing the latch 320 in a locked position (See FIG. 12). In said locked position, the angled surface 354*a* is disposed between the tab 328 and the flange 326, inhibiting the removal of a cord disposed between the cord guide surfaces 309*a*, 309*b* and the latch 320. One of ordinary skill in the art will readily recognize that the locking mechanism 350 can be actuated by rotating the latch 320 in the downward direction 360 so that the tab 328 slides over the angled surface 354*a*, as described above, as well as through the actuation of the button 352, as discussed below.

In the illustrated embodiment, the locking mechanism 350 can be actuated to unlock the latch 320 by pressing the button 352 in the forward direction 362, which causes the locking member 354 to also move forward. Once the bottom of the angled surface 354*a* clears the tab 328, the latch 320 could then be rotated outward to withdraw the latching member 324 from the compartment 342. A cord disposed in the cord passage 330 could then be withdrawn from between the cord guide surfaces 309*a*, 309*b* and the latch 320.

Figure 13:
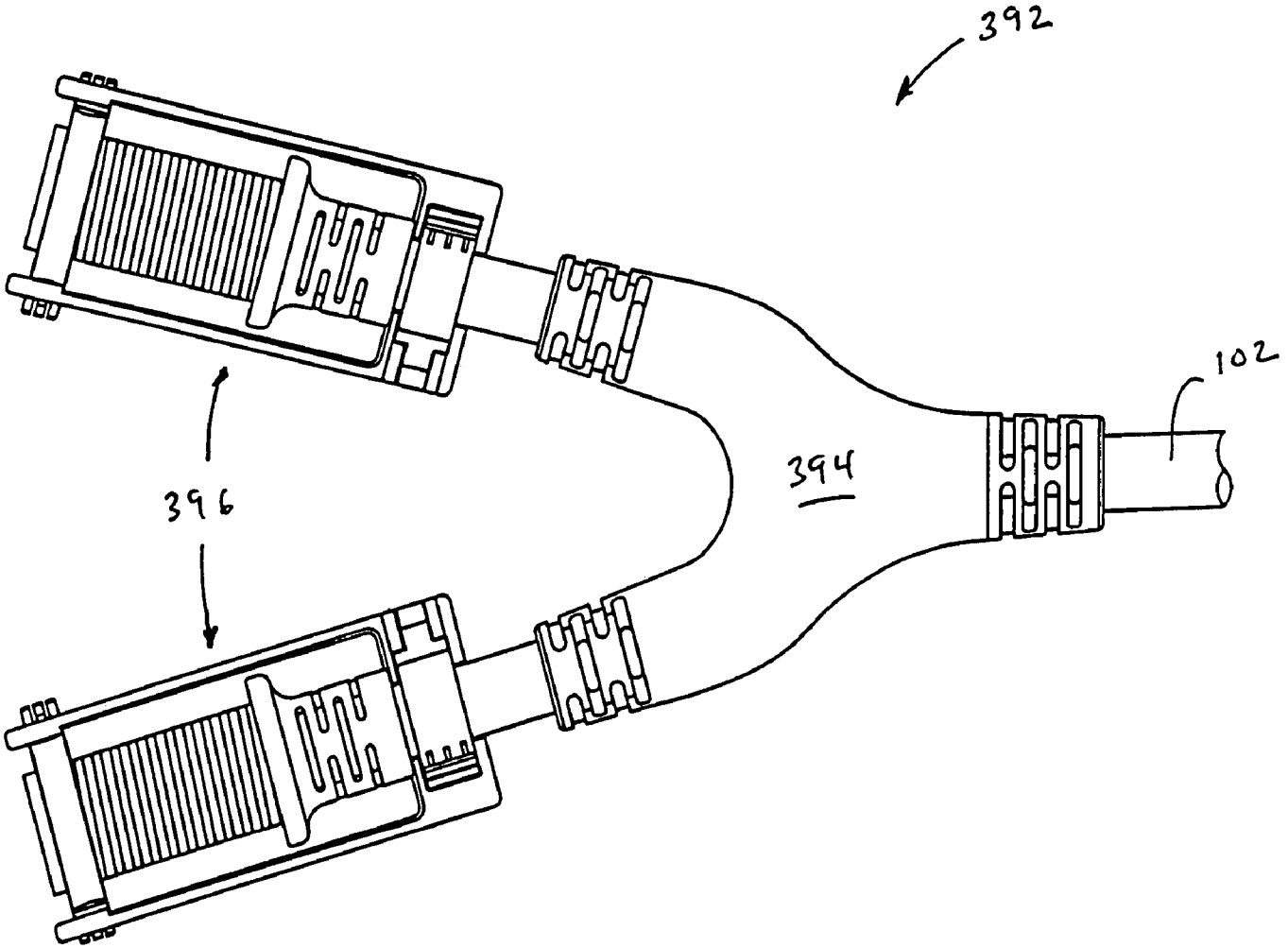
FIG. 13 illustrates yet another embodiment of the plug retention apparatus.

FIG. 13 illustrates yet another embodiment of a plug retention apparatus. In the illustrated embodiment, the plug retention apparatus is a dual plug retention apparatus 392. Preferably, the electrical cord 102 is attached to a Y adaptor 394, which enables two retention apparatuses 396 to be attached to the electrical cord 102. Preferably, the retention apparatuses 396 are configured in accordance with any of the embodiments disclosed herein. Although FIG. 13 only shows two plug retention apparatuses 396, one of ordinary skill in the art will recognize that more than two plug retention apparatuses could be attached to the electrical cord 102 without deterring from the spirit of this invention. This dual plug retention apparatuses 396 advantageously allow the user to utilize one electrical plug for multiple tools, as well as prevent all the tools from becoming disengaged from the electrical plug.

Figure 14:
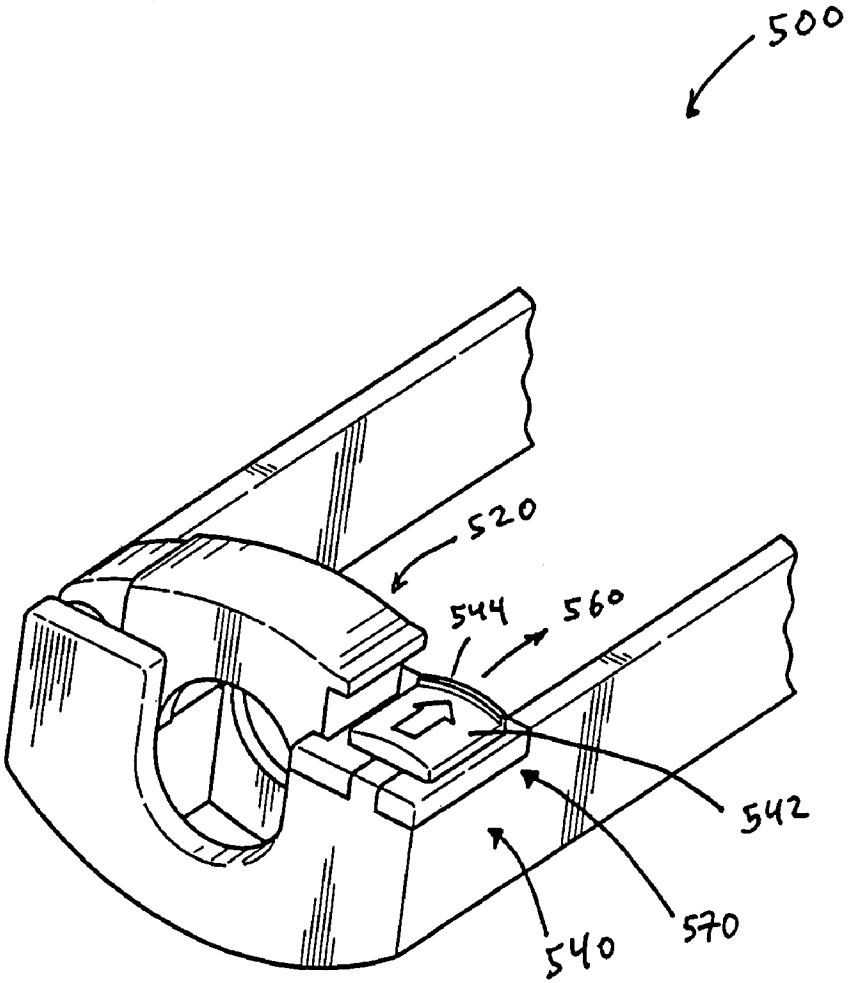
FIG. 14 is another embodiment of a securing member of the plug retention apparatus.

FIG. 14 illustrates yet another embodiment of a plug clamp 500. The plug clamp 500 includes a locking mechanism 540 for removably securing a latch 520 in a locked position. In the illustrated embodiment, the latch 520 can be rotated downward into locking engagement with the locking mechanism 540 in a manner similar to that described above with respect to FIGS. 9–12. The locking mechanism 540 includes a tab 542 actuatable to release the latch 520 from the locked position. As shown in FIG. 14, the tab 542 can be moved in a forward direction 560 to release the latch 520. Preferably, the tab 542 is biased, for example, via a spring, to return to a rest position 570 after actuation. In the illustrated embodiment, the tab 542 has a ridge 544 configured to facilitate the actuation of the tab 542, for example, by a user's finger.

Figure 15:
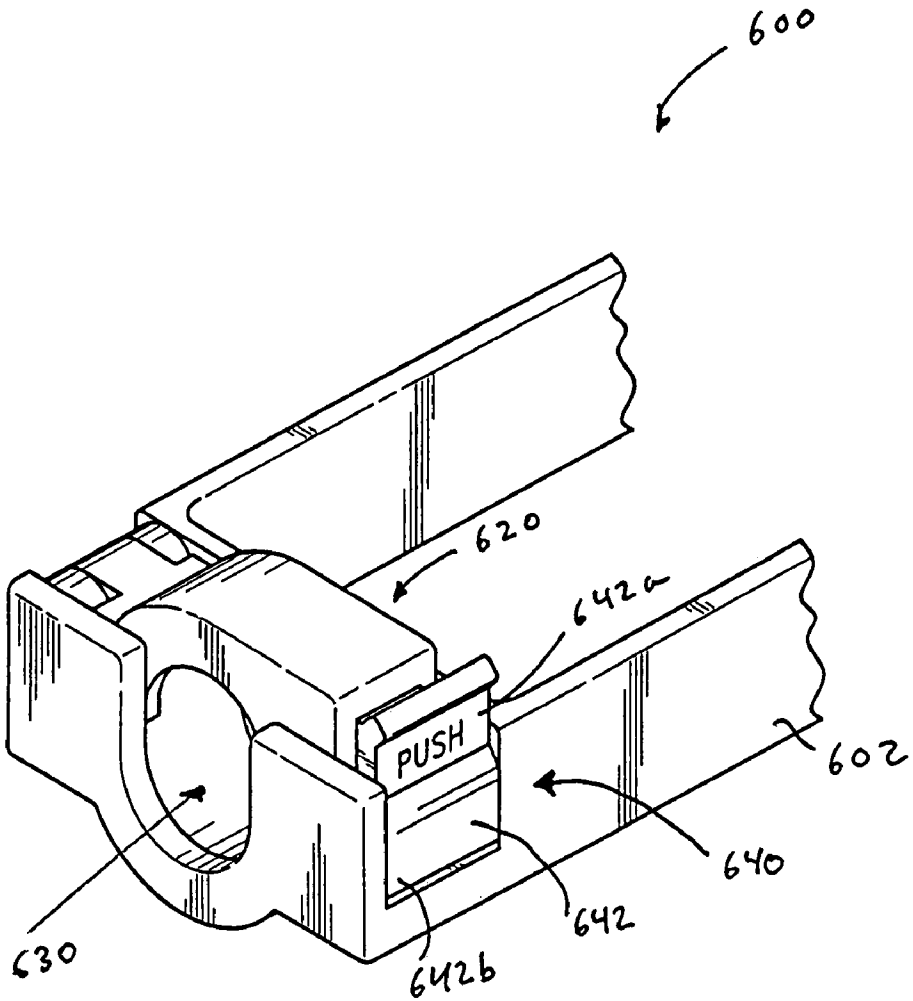
FIG. 15 is another embodiment of a securing member of the plug retention apparatus.

FIG. 15 illustrates yet another embodiment of a plug clamp 600. The plug clamp 600 includes a locking mechanism 640 for removably securing a latch 620 in a locked position. In the illustrated embodiment, the latch 620 can be rotated downward into locking engagement with the locking mechanism 640. The locking mechanism 640 includes a lever 642 pivotably connected to the latch 620 and having an upper portion 642*a* and a lower portion 642*b*. Preferably, the lever 642 is pivotable about an axis disposed between the upper and lower portions 642*a*, 642*b* and extending generally parallel to an elongated member 602 of the clamp 600. In the locked position, as shown in FIG. 15, the lower portion 642*b* of the lever 642 preferably lockingly engages a locking member (not shown) disposed, for example, on the elongated member 602. Accordingly, as the latch 620 is rotated downward, the lower portion 642*b* of the lever 642 pivots outward over the locking member, then inward to engage said locking member. To release the latch 620, a user would press on the upper portion 642*a* of the lever, thus withdrawing the lower portion 642*b* of the lever 642 from engagement with the locking member. The latch 620 could then be rotated upward to expose a cord (not shown) disposed in a cord passage 630. One of ordinary skill in the art will readily recognize that in another embodiment the lever 642 could alternatively be pivotably connected to the elongated member 602 and the locking member could be disposed on the latch 620. In said embodiment, as the latch 620 was rotated downward, the upper portion 642*a* of the lever 642 would pivot outward over the locking member and then inward to engage said locking member. To release the latch 620, a user would press the lower portion 642*b* of the lever, thus withdrawing the upper portion 642*a* of the lever 642 from engagement with the locking member.

From the foregoing, it will be appreciated that the plug retention apparatus 100, 300, 500, 600 provides a convenient way in which to secure plug components 120, 200 that are to be joined to one another preventing disengagement until desired. Advantageously, the adjustable aspect of the retention ring 130 provides a mechanism by which to secure a variety of different plug configurations desirably accommodating different plug and cord sizes. Moreover, the ability to angularly displace the plug clamp 135 away from the plug members 105, 202 allows the plug components 120, 200 to be rapidly engaged and disengaged as desired while still maintaining a securing force to the joined plug components when positioned axially in-line with the first plug member 105. Furthermore, the rotating ability of the retention ring 130 can be used to secure the plug members tightly by engaging the plug clamp 135 and then cinching down upon the joined plug members by rotating the retention ring 130 towards the base 115. When such an operation is performed, the plug members may be retained in a tightly secured configuration resilient to separation.

A wide variety of materials may be used to construct the plug retention apparatus 100, 300, 500, 600 and may include by way of example: plastic, nylon, metal, wood, or other materials. In addition, the various components of the plug retention apparatus 100, 300, 500, 600 may be constructed from different materials as desired. Additionally, the retention ring 130 may be adapted to be secured to and moved about the first or second plug member 105, 200 in a manner other than rotatable movement. For example, the retention ring 130 may be adapted with a latching means such that it can be moved up and down the first plug member 105 without rotation of the retention ring 130. In this configuration, the retention ring 130 may be secured to the first plug member by a series of movement-retarding latches as will be appreciated by one of skill in the art. In other embodiments, the plug retention apparatus 100, 300, 500, 600 may be desirably adapted to be formed on a male plug member wherein a female plug member 105 is captured by the plug clamp. Furthermore, the apparatus 100, 300, 500, 600 may be adapted with a variety of other different plug configurations/combinations as desired to securely join the plug members.

Of course, the foregoing description is that of certain features, aspects and advantages of the present invention, to which various changes and modifications can be made without departing from the spirit and scope of the present invention. Moreover, the plug retention apparatus need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed plug retention apparatus.

What is claimed is:

1. An electrical cord retention apparatus for maintaining electrical connection between a first and a second electrical cord, comprising:

a retainer assembly that couples to a first electrical cord which includes a support surface that receives a second electrical cord;

a securing member movably attached to the retainer assembly wherein the securing member is movable between a first orientation thereby allowing the second electrical cord to be positioned adjacent the support surface and a second orientation wherein the securing member secures the second electrical cord adjacent the support surface; and a mechanism for inhibiting the withdrawal of the securing member from the second orientation, the mechanism including an actuator and a locking member configured to slidably move into engagement with the securing member when the securing member is moved into the second orientation.

2. The apparatus of claim 1, wherein the mechanism locks the securing member in the second orientation.

3. The apparatus of claim 1, wherein the securing member is a latch.

4. The apparatus of claim 1, wherein the actuator is a button.

5. The apparatus of claim 4, wherein the button is disposed so as to be actuatable by a force applied in a generally normal direction relative to a plane in which the securing member moves.

6. The apparatus of claim 1, wherein the actuator is a tab.

7. The apparatus of claim 6, wherein the tab is disposed so as to be actuatable by a force applied generally parallel and normal to a face of the tab.

8. The apparatus of claim 1, wherein locking member is biased to maintain the mechanism in a rest position.

9. The apparatus of claim 8, wherein locking member is biased by a spring.

10. The apparatus of claim 1, wherein the securing member is pivotably coupled to the retainer assembly.

11. The apparatus of claim 10, wherein the securing member is pivotably coupled via a hinge.

12. The apparatus of claim 1, wherein a tab of the securing member is configured to slide over an angled surface of the locking member, the tab further configured to move under the angled surface to thereby engage the locking member.

13. The apparatus of claim 12, wherein the movement of the tab over the angled surface causes the locking member to slidably move from a rest position, the locking member returning to the rest position when the tab moves under a bottom portion of the angled surface.

14. An electrical cord retention assembly for maintaining electrical connection between a first and a second electrical cord, comprising:

a first electrical cord suitable for conducting electricity;

a first plug member electrically coupled to the first electrical cord, wherein the first plug member is adapted to receive a second plug member coupled to a second electrical cord;

a ring member rotatingly coupled to the first plug member;

a retainer assembly coupled to the ring member and including a support surface that receives the second electrical cord;

a latch pivotably coupled to the retainer assembly via a hinge, wherein the latch is pivotable between an open position to allow the second cord member to be positioned on the support surface and a closed position wherein the latch secures the second cord member adjacent the support surface, the latch having a tab; and a mechanism for inhibiting the withdrawal of the latch from the closed position, the mechanism including an actuator coupled to a locking member, the locking member configured to slidably move into engagement with the tab when the latch is moved into the closed position.

15. The assembly of claim 14, wherein the mechanism locks the latch in the closed position.

16. The assembly of claim 14, wherein the actuator is a button.

17. The assembly of claim 16, wherein the button is disposed so as to be actuatable by a force applied in a generally normal direction relative to a plane in which the latch moves.

18. The assembly of claim 14, wherein the actuator is a tab.

19. The assembly of claim 18, wherein the tab is disposed so as to be actuatable by a force applied generally parallel and normal to a face of the tab.

20. The assembly of claim 14, wherein locking member is biased to maintain the mechanism in a rest position.

21. The assembly of claim 20, wherein locking member is biased by a spring.

22. The assembly of claim 14, wherein the tab is configured to slide over an angled surface of the locking member, the tab further configured to move under the angled surface to thereby engage the locking member.

23. The assembly of claim 14, further comprising a third plug member electrically coupled to the first electrical cord, the first and third plug members coupled to the first electrical cord via a Y-connector, wherein the third plug member is adapted to receive a fourth plug member coupled to a third electrical cord;

a second ring member rotatingly coupled to the third plug member;

a second retainer assembly coupled to the second ring member and including a second support surface that receives the third electrical cord;

a second latch pivotably coupled to the second retainer assembly, wherein the latch is pivotable between an open position and a closed position, wherein the second latch secure the third electrical cord adjacent the second support surface; and a second mechanism for inhibiting the withdrawal of the latch from the closed position.

24. A method of securing an electrical cord, comprising;

positioning a cord retaining device on a first electrical cord;

engaging a second electrical cord with the cord retaining device so as to maintain the second electrical cord in electrical contact with the first electrical cord; and inhibiting the disengagement of the second electrical cord from the cord retaining device by actuating a mechanism to slidingly move a locking member into engagement with a securing member, wherein engaging a second electrical cord with the cord retaining device includes positioning the second electrical cord on a support surface of the retaining device and moving the securing member movably coupled to the retaining device from a first orientation to a second orientation to secure the second electrical cord adjacent the support surface.

25. The method of claim 24, wherein positioning the cord retaining device on the first electrical cord includes rotatingly coupling a ring member to a first plug member that is electrically coupled to the first electrical cord.

* * * * *